US006043192A

United States Patent [19]

Fukumuro et al.

[11] Patent Number: 6,043,192

[45] Date of Patent: Mar. 28, 2000

[54] THERMAL TRANSFER RECORDING METHOD

[75] Inventors: Kaori Fukumuro; Shigeru Mano; Hiroshi Watanabe, all of Hino, Japan

[73] Assignee: Konica Corporation, Tokyo, Japan

[21] Appl. No.: 09/063,923

[22] Filed: Apr. 22, 1998

[30] Foreign Application Priority Data

Apr. 24, 1997 [JP] Japan ..... 9-107253

[51] Int. Cl.[7] ..... B41M 5/035; B41M 5/38

[52] U.S. Cl. ..... 503/227; 428/195; 428/913; 428/914

[58] Field of Search ..... 8/471; 428/195, 428/913, 914; 503/227

[56] References Cited

U.S. PATENT DOCUMENTS

| | | | |
|---|---|---|---|
| 4,987,049 | 1/1991 | Komamura et al. | 430/203 |
| 5,489,567 | 2/1996 | Koshizuka et al. | 503/227 |

FOREIGN PATENT DOCUMENTS

| | | | |
|---|---|---|---|
| 7-108772 | of 0000 | Japan | 503/227 |
| 59-78893 | 5/1984 | Japan | 503/227 |
| 59-109349 | 6/1984 | Japan | 503/227 |
| 60-2398 | 1/1985 | Japan | 503/227 |
| 4-55870 | 2/1992 | Japan . | |
| 4-89292 | 3/1992 | Japan . | |
| 4-94974 | 3/1992 | Japan . | |
| 4-97894 | 3/1992 | Japan . | |
| 7-108772 | 4/1995 | Japan . | |

*Primary Examiner*—Bruce H. Hess
*Attorney, Agent, or Firm*—Finnegan, Henderson, Farabow, Garrett & Dunner, L.L.P.

[57] ABSTRACT

A thermal transfer recording method is disclosed. The process comprises a recording material comprising a support having thereon an ink layer containing a thermally diffusible chelatable dye and an image-receiving material comprising a support having thereon an image-receiving layer containing a compound having metal ions are superposed so that the ink layer of a recording material and the images-receiving layer of an image-receiving material are brought into contact with each other; the superposed recording material is heated imagewise employing a thermal head, whereby the thermally diffusible chelatable dye is transferred to the image-receiving layer to form an image; the image-receiving material having the image and a releasing agent-containing thin sheet material are brought into contact so that the image-receiving layer is brought into contact with the image-receiving layer; and the image-receiving material is heated through the thin sheet material.

15 Claims, 1 Drawing Sheet

THERMAL TRANSFER RECORDING METHOD

FIELD OF THE INVENTION

The present invention relates to a thermal transfer recording method, and more specifically, to a thermal transfer recording method to form a color image employing a recording material comprising an ink layer containing a thermally diffusible chelatable dye, and an image-receiving layer comprising a compound containing metal ions.

BACKGROUND OF THE INVENTION

As the thermal transfer recording technology, there is a method in which a recording material (hereinafter occasionally referred to as an ink sheet) comprising a base material having thereon a thermally fusible ink layer or an ink layer comprising a thermally sublimable dye, and an image-receiving material (occasionally referred to as an image-receiving sheet) are opposed each other, and a heat source controlled by electric signals of a thermal head, an electricity-turning head, etc. is provided from the side of the ink sheet pressed for contact, and images are thus transfer-recorded. The thermal transfer recording provides advantages such as silence, very negligible requirements for maintenance, low cost, easy formation of color images, availability of digital recording and the like. Accordingly, the thermal transfer recording has been employed in a variety of fields such as printers, recorders, facsimile machines, computer terminals and the like.

The sublimable type thermal transfer recording has received attention because of its advantages in the adaptation to color image formation and tone reproduction. Further the quality of formed images is comparable to that obtained by the photographic method employing silver salts. However, the images formed by the sublimable dye has been noted to exhibit a problem of fixability or immobilization.

In order to improve the fixability, a method has been known in which after completing the image formation, the image further undergoes thermal treatment to yield prescribed dye formation, while pushing the dye into the interior of the image-receiving layer. For example, Japanese Patent Publication discloses that a non-transfer region, where no sublimable dyes is coated, is provided or the successive face order sublimable transfer sheet, and during thermal transfer printing, the non-transfer sheet completing the transfer is heated again. However, this method requires a large useless area on the transfer sheet and causes an increase in material waste.

Furthermore, for improving the stability of images as well as solving the fixability problem, a method has been proposed in which an image-protecting layer is formed. Methods for forming such an image-protecting layer are: lamination, transfer of transfer foil on the image, etc. However, these methods need a non-transfer support and a laminating material which are durable under high temperatures, causing an increase in cost.

As a method to obtain sufficient image stability without employing an image-protecting layer, it has been proposed that a thermally diffusible chelatable dye (hereinafter referred to as a post-chelate dye) is transferred into an image-receiving layer comprising it compound containing metal ions to improve the fixability through the chelation in the image-receiving layer. Japanese Patent Publication Open to Public Inspection Nos. 59-78893, 59-109349, 60-2398, etc., for example, describe such a method. In these patents, it is illustrated that the light fastness and fixability of the images formed, which employ the post-chelate dye, are much improved compared to those formed by employing conventional sublimable dyes.

The post-chelate dyes, disclosed in the above-mentioned patents, etc., are those which form bidentate-ligand or tridentate-ligand chelate dyes. In the thermal transfer recording employing these dyes, there is a large difference in hue between the post-chelate dye and the chelate dye. As a result, when the chelation reaction is not sufficiently completed, the color reproduction area is decreased due to the occurrence of undesirable secondary absorption and have occasionally caused insufficient image stability. Due to these, it is proposed to carry out a post thermal treatment and the like to fully complete the chelation reaction.

In order to complete the chelation reaction, the image materials are subjected to high temperatures in the range of about 150 to about 200° C. Accordingly, as heating devices, thermal heads and heat rollers are employed which save space. The heat rollers can be preferably employed as economical materials. When the image-receiving material completing the image formation is processed employing a heat roller device, not only is the roller strained with the transfer of the chelate dye, but also when another image-receiving material completing the other image formation is processed, the dye transferred to the roller is again transferred back to the surface of the image-receiving material which markedly degrades the image quality due to such stains. Furthermore, direct-heating the surface of the image employing the thermal head damages the image due to the thermal head.

Furthermore, as technology in regard to the post-heating processes, Japanese Patent Publication No. 4-55870 discloses a technology in which the post-heating is carried out, via the part of an ink sheet where no dye is coated, employing the same thermal head as that utilized to form the image. Japanese Patent Publication Open to Public Inspection No. 7-108772 discloses a technology in which, after forming an image employing a thermal head, the surface of the image is subjected to heating process via a sheet of plastic film employing a thermal head that is different from that employed to form the image. In these technologies, are mainly employed the film which is connected with an ink sleet in the face order and in the same way as for the ink sheet, one sheet is consumed for one image. And these films employed for post-heating do not particularly perform any processing and when brought into contact with the surface of the image, the dye is reversibly transferred; when the same film is repeatedly employed, it occasionally adheres onto the surface of the next image. Thus, these cause problems such that material waste increases together with an increase in ink sheets and image density decreases due to the reverse transfer of the dye to the film.

SUMMARY OF THE INVENTION

In a thermal transfer recording method employing the above-mentioned thermally diffusible chelatable dye, the present invention provides a thermal processing method, which increases neither cost nor causes material waste, and is readily handled when an image receiving material on which an image has been formed undergoes thermal treatment in order to improve the image stability and color reproduction.

In a thermal transfer recording method in which an ink layer of a recording material comprising a support having thereon an ink layer containing a thermally diffusible chelatable dye and an image-receiving layer of an image-receiving material comprising a support having thereon an image-receiving layer containing a compound having metal ions are opposed and in contact with each other; are heated imagewise employing a thermal head. By so doing, the above-mentioned thermally diffusible chelatable dye is transferred onto the image-receiving layer, and thereafter, the image-forming surface of the image-receiving material undergoes post-heating, a thermal transfer recording method in which a releasing agent-containing thin sheet material is brought into contact with the image forming surface of the image-receiving material and through the thin sheet material, the image-receiving material is heated.

The image-receiving layer preferably comprises a compound containing polyvalent metal ions with not less than divalence.

The thin sheet material comprises a releasing agent on or in the sheet material.

In one embodiment, the thin sheet material comprises a releasing layer on the surface. In another embodiment, a releasing agent is impregnated or knead mixed into the thin sheet material.

DETAILED DESCRIPTION OF THE INVENTION

Figure 1:
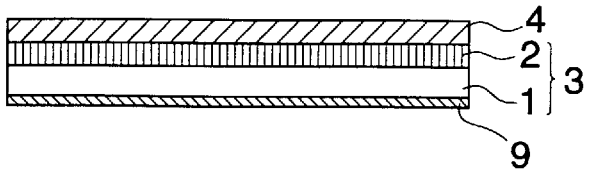
FIG. 1 is a sectional view showing contact of an image-forming surface of an image-receiving material with a thin sheet material.

The thermally diffusible dye transferred to an image-receiving material combines with a compound comprising metal ions contained in the image-receiving layer and the dye is immobilized. By heating the immobilized dye, the bond between the dye and the metal ion-containing compound is strengthened to stabilize the image. Heating is carried out employing a releasing agent containing a thin sheet material, so that no dye in the image-receiving layer moves onto another layer in such a way that the image-receiving layer is not brought into direct contact with the heating device. The heating device is composed of a pair of opposed rollers, at least one of which is a heat roller, a bed for conveying the image-receiving material and a heat roller provided on the bed and the like. Heating is preferably carried out by the heat roller. A conveying roller is preferably provided facing the heat roller. This conveying roller may be provided with a heating means. Heating is preferably carried out from the thin sheet material side so that the thin sheet material comprising the releasing agent is brought into contact with the image-receiving layer.

The thin sheet material comprising the releasing agent has a layer comprising the releasing agent on the thin sheet material or comprises the releasing agent in the interior of the thin sheet material. The thin sheet material comprising the releasing agent is prepared by coating a composition obtained by dissolving or dispersing the releasing agent in the thin sheet material employing a solvent, or by coating a composition comprising a binder such as synthetic resins, etc., and a solvent, if desired. The thin sheet material comprising the releasing agent in the interior of the thin layer itself is prepared by kneading the releasing agent with the thin sheet material or materials forming the thin sheet material or impregnating the releasing agent into the thin sheet material.

The thin sheet material preferably has a thickness of between 5 to 500 $\mu$m. Those having a thickness of 50 to 200 $\mu$m are more preferably employed in terms of advantages such as heat conductivity and shape stability.

Examples of these thin sheet materials include plastic films or sheets such as vinyl chloride series resins, ABS resins, polyethylene terephthalate (PET) base film, polyethylene naphthalate (PEN) base film; films or sheets composed of various metals or various ceramics or papers.

Glass transition temperatures of the thin sheet material is not lower than 70° C.

As releasing agents, there can be employed fluororesins, silicone resins, fatty acid esters, fatty acid metal salts, fatty acid amides, aliphatic alcohols, polyhydric alcohols, paraffin, zinc stearate, fluorocarbons, solid waxes such as polyethylene wax, polypropylene wax, etc., water-soluble high polymer resins such as gelatin, casein, etc.

The most preferable example of releasing compound is fluororesins, silicone resins, fatty acid esters, paraffin or gelatin.

Particularly preferred are releasing agents such as silicone resins. The silicone resins include polyester-modified silicone resins (or silicone-modified polyester resins), acryl-modified silicone resins (or silicone-modified acrylic resins), cellulose-modified silicone resins (or silicone-modified cellulose resins), urethane-modified silicone resins (or silicone-modified urethane resins), alkyd-modified silicone resins (or silicone-modified alkyd resins), epoxy-modified silicone resins (or silicone-modified epoxy resins), etc., or various resins (acrylic resins, etc.) comprising silicone resin particles), etc.

A recording material comprises a support having thereon an ink layer containing a thermally diffusible chelatable dye.

Supports may include those having dimensional stability against heat to endure the heat when recorded by thermal head. Examples include such paper as condenser paper and glassine paper, and heat resisting plastic film such as polyethylene-terephthalate, polyamide, polyimide, polycarbonate, polysulfone, polyvinylalcohol cellophan, and polystyrene.

The thickness of the support is generally between 2.0 to 10.0 $\mu$m.

The shape of the thin sheet materials is various according to the way of imagewise heating, and may be a wide web, sheet or film, or a narrow tape or card.

The ink layer basically comprises a thermally transferable dye. This thermally transferable dye may include cyan dyes, magenta dyes, and yellow dyes.

The post-chelation type dye enabling the formation of a chelate includes, for example, cyan dyes, magenta dyes, and yellow dyes capable of forming at least a bidentate chelate described in Japanese Patent Publication Open to Public Inspection Nos. 59-78893, 59-109349, 4-94974, 4-89292 and 4-97894.

Preferred thermally transferable chelatable dyes are represented by the general formula shown below.

$X_1—N=N—X_2—G$ wherein $X_1$ represents a group of atoms necessary for completing an aromatic carbon ring or heterocyclic ring in which at least one of rings is composed of 5 to 7 atoms, and in which at least one of atoms in the position adjacent to the carbon atom bonded to an azo bond is a carbon atom substituted with a nitrogen atom or a chelate group. $X_2$ represents an aromatic heterocyclic ring or an aromatic carbon residual group in which at least one of rings is composed of 5 to 7 atoms. G represents a chelatable group.

Binders preferably exhibit minimum dyeing affinity with thermally transferable dyes and minimum fusing adhesion at thermal transfer, and specifically include silicone resins, polyethylene resins, polypropylene resins, ethylene-vinyl acetate resins, ethylene-ethylacrylate resins, acrylic resins, rubber series elastomer such as styrene-butylene-styrene block polymer, etc., fluororesins, hardened polyfunctional oligoacrylates, and the like.

The image-receiving material comprises a support having thereon an image-receiving layer comprising a compound containing metal ions and preferably comprises, for regulating hues of the finished images, chelatable dyes employed in the ink sheet or/and a small amount (about 0.0003 to about 0.02 weight percent of the total compositions of the image-receiving layer) of a cyan dye, a magenta dye, and yellow dye.

Binders employed for the metal ion-containing compound may include, for example, polyvinyl chloride resins, copolymer resins of vinyl chloride with other monomers (isobutyl ether, vinylpropionate, etc.), polyester resins, poly(metha) acrylic acid esters, polyvinylpyrrolidone, polyvinyl acetal series resins, polyvinyl butyral series resins, polyvinyl alcohols, polycarbonates, cellulose triacetate, styrene, copolymers of styrene with other monomers (acrylic acid esters, acrylonitrile, ethylene chloride, etc.), vinyltoluene-acrylate resins, polyurethane resins, polyamide resins, urea resins, epoxy resins, phenoxy resins, polycaprolactone resins, polyacrylonitrile resins, and modified compounds of these.

Of the above resins, those which are preferred include polyvinyl chloride resins, copolymers of vinyl chloride with other monomers, polyester resins, polyvinyl acetal series resins, polyvinyl butyral series resins, copolymers of styrene with other monomers and epoxy resins. Further, these resins may be employed individually or in combination such a way that two resins or more are mixed. The above-mentioned resins may be synthesized when employed or commercially available products may be employed.

Compounds containing metal ions (hereinafter referred to as a metal source) include inorganic or organic salts of metal ions and metal complexes. Of these, organic metal salts and complexes are preferred. Metals include monovalent and polyvalent metals of to Periodic Table group VIII. Of these, preferred are Al, Co, Cr, Cu, Fe, Mg, Mn, Ni, Sn, Ti, and Zn, and particularly preferred are Ni, Cu, Cr, Co, and Zn.

Specific examples of the metal source include $Ni^{2+}$, $Cu^{2+}$, $Cr^{2+}$and $Zn^{2+}$, and salts of fatty acids such as acetic acid, stearic acid, etc. or salts of aromatic carboxylic acids such as benzoic acid, salicylic acid, etc. Complexes represented by the general formula are preferably employed because these can be incorporated into the image-receiving layer in a stable manner and are substantially colorless.

$$[M(Q_1)_X(Q_2)_Y(Q_3)_Z]^{P+}(L^-)^P$$

wherein M represents metal ions, and preferably $Ni^{2+}$, $Cu^{2+}$, $Co^{2+}$, and $Zn^{2+}$. $Q_1$, $Q_2$, and $Q_3$ each independently represents a coordination compound which can undergo coordination bonding with metal ions represented by M, which may be the same or different. These coordination compounds may be selected from those described in, for example, Chelate Kagaku (Chelate Science) (5) published by Nankodo). $L^-$represents an organic anion, and specifically includes tetraphenylboron anion, alkyl benzene sulfonate anion, etc. X represents an integer of 1, 2 or 3; Y represents 1, 2 or 0, and Z represents 1 or 0. However, these are dependent on tetradentate or hexadentate of the complex represented by the above-mentioned general formula or the number of ligands of $Q_1$, $Q_2$, and $Q_3$. P represents 1 or 2. Specific examples of these types of metal sources may include these illustrated in U.S. Pat. No. 4,987,049.

The added amount of the metal source is preferably between 5 and 80 weight percent of the binder for the image-receiving layer and more preferably between 10 and 70 weight percent. There is preferably incorporated, for regulating hues of the finished images, chelatable dyes employed in the ink sheet or/and a small amount (about 0.0003 to about 0.02 weight percent of the total compositions of the image-receiving layer).

Supports may include various types of papers such as paper, coated paper, and synthetic paper (polypropylene, polystyrene, or composite materials which are prepared by laminating any of these to paper), various types of plastic films and sheets such as opaque polyvinyl chloride resin sheets, white PET films, transparent PET films, PEN films, etc.

The thickness of the support is generally between 100 to 1,500 $\mu$m and preferably between 100 and 1,000 $\mu$m.

The support preferably contains white pigment such as titanium white, magnesium carbonate, zinc oxide, barium sulfate, silica, clay and calcium carbonate to enhance the clarity of the transferred image.

The thermal transfer recording method is employed to output images for the system schematically composed of an image original, an image input, an information transmission medium, an image edit processing device, an information transmission medium, and an image output.

The images are input employing a scanner, while utilizing, as image originals, reflection originals such as printed matter and photographic prints, and transparent originals such as negative (or positive) films, etc. Furthermore, video images can be input employing special image input devices such as a videoboard, etc. Besides these, data stored already in CD-ROM, etc. can be directly utilized.

Any information transmission medium employed may be, if it can transmit image data to an edit processing device or output device. Specifically, employed may be floppy disks, hard disks, CD-ROMs, a streamer, optical magnetic disk and the like. Furthermore, images may be transmitted employing communication lines such as a telephone line, etc., or directly employing an interface cable.

As the image edit processing means, those are employed in which software on edit and color management is loaded on a host computer such as a general personal computer, a work station, etc.

As the image output device, those capable of performing thermal recording are employed. Specifically, are employed general sublimation type thermal transfer printers comprising a thermal head as the heat source. The sublimation type thermal transfer printers are preferably employed which have an accuracy of superimposed printed letters of each color of not more than 40 $\mu$m.

The image-receiving material, on which a color image is formed via thermal transfer is heated through a thin sheet material by the heat roller of a thermal processing device.

Heating conditions at the post-thermal process for the image-forming surface of the image-receiving material are at 70 to 200° C. and the conveying speed is preferably 0.3 to 3.0 m/sec.

Figure 4:
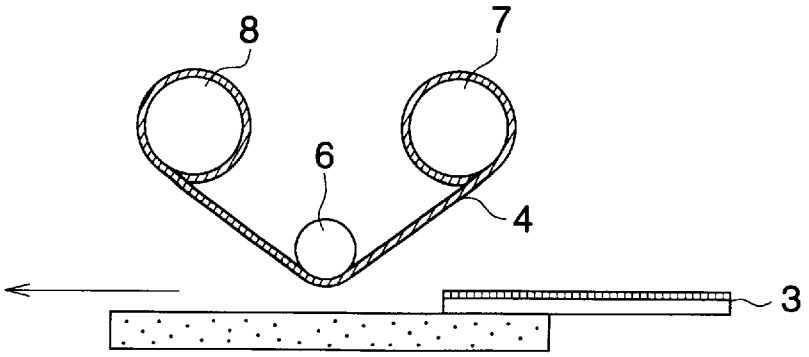
FIG. 4 is a sectional view showing an example of a post-thermal processing device in thermal transfer recording suitable for the embodiment of the present invention.

A thermal processing device illustrated in FIG. 4 ray be employed which is arranged in such a way that at post-heating, other rollers 7 and 8 are provided before and after the heat roller 6 of the thermal processing device and the thin sheet material 4 wound on the front roller 7 is unwound between the heat roller and the image-receiving material completing the dye transfer when the image receiving material completing the dye transfer is passed through the thermal processing device and conveyed, and wound on the back roller 8.

The thin sheet material is employed in such a state that the leading edge in the conveying direction is folded so as to sandwich the image-receiving material.

Figure 3:
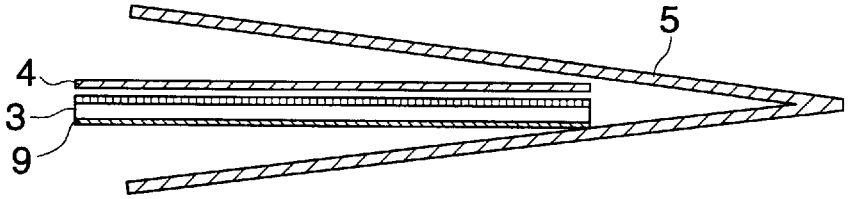
FIG. 3 is a sectional view showing a thin sheet material and an image-receiving material which has completed image formation sandwiched by a commonly used sheet material.

After the dye transfer, the image-receiving material 3 and the thin sheet material 4 are sandwiched with another sheet connecting with at least one side of the sheet 5, and conveyed so that the connected side is arranged as a leading edge for conveyance as shown in FIG. 3.

The thin sheet material may be employed twice, on the front and back surfaces.

The thin sheet material may comprises releasing layers on both sides.

The thin sheet material is supplied at each time when the image-receiving material completing the dye transfer is passed through the thermal processing device.

A plate-like rigid body is preferably placed between the reverse side of the image-forming side of the image-receiving material and the thin sheet material. By doing so, the deformation of a image-receiving sheet due to pressure and heat can be prevented.

The "rigid body" in the present invention is a body which is not deformed in an automatic conveying heating device equipped with a heat roller, etc., and specifically includes plates of metals such as aluminum, stainless steel or copper, pulp paper, synthetic paper, wooden plates, etc.

The thicker the above-mentioned plate, the easier the sufficient stiffness is obtained. However, when plates having large heat conductivity are employed, excessive thickness decreases sensitivity. Therefore, depending on rigidity of the substance, a thickness in the range of 50 $\mu$m to 10 mm is generally acceptable. Further, the rigid body employed for the heat roller is preferably of metal such as aluminum, stainless steel, copper, etc. in terms of heat tolerance.

EXAMPLES

The present invention is specifically described with reference to Examples. Parts in Examples are by weight, unless otherwise specified.

(Preparation of Ink Sheet)

On the reverse surface of the protective layer side of 6 $\mu$m PET film (Rumiler 6CF531 manufactured by Toray) having the heat-resistant protective layer, the following ink layer-forming coating compositions were coated and dried with a wire bar coating method so as to obtain a thickness after drying of 1 $\mu$m, by which a magenta, a cyan, and a yellow sheets were prepared.

| Ink Layer-forming Coating Composition (magenta) | |
|---|---|
| Post-chelate dye (M-1) | 2.0 parts |
| Polyvinyl acetal (manufactured by Denki Kagaku Kogyo: KY-24) | 3.0 parts |
| Methyl ethyl ketone | 66.5 parts |
| Cyclohexanone | 28.5 parts |
| Ink Layer-forming Coating Composition (cyan) | |
| Post-chelate dye (C-1) | 1.5 parts |
| Polyvinyl acetal (KY-24: manufactured by the same as above) | 3.5 parts |
| Methyl ethyl ketone | 66.5 parts |
| Cyclohexanone | 28.5 parts |
| Ink Layer-forming Coating Composition (yellow) | |
| Post-chelate dye (Y-1) | 1.5 parts |
| Polyvinyl acetal (KY-24: manufactured by the same company as above) | 3.5 parts |
| Methyl ethyl ketone | 66.5 parts |
| Cyclohexanone | 28.5 parts |

M-1

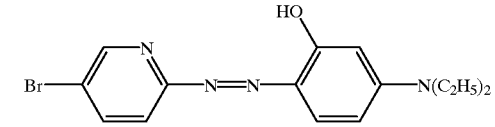

C-1

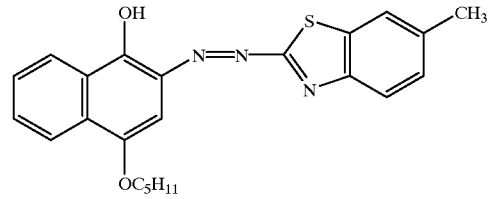

Y-1

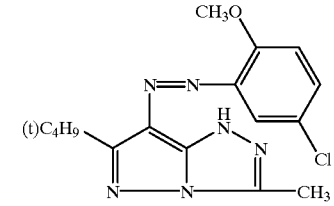

(Preparation of Image-receiving Sheet)

On a 175 $\mu$m synthetic paper support (manufactured by Oji Yuka: YUPO), an anchor layer-forming coating composition and an image-receiving layer-forming coating composition 1 having the following compositions were successively coated with a wire bar coating method and dried to obtain a thickness of the dried anchor layer of 0.5 $\mu$m and a thickness of the dried image-receiving layer of 4 $\mu$m, from which are image-receiving sheet was prepared.

| Anchor Layer-forming Coating Composition | |
|---|---|
| Polyvinyl butyral (manufactured by Sekisui Kagaku: Eslex BX-1:) | 9.0 parts |
| Isocyanate (manufactured by Nihon Urethane: Coronate HX:) | 1.0 part |
| Methyl ethyl ketone | 80.0 parts |
| butyl acetate | 10.0 parts |
| Image-receiving Layer-forming Coating Composition | |
| Polyvinyl butyral (manufactured by Sekisui Kagaku: Eslex BX-1:) | 35.0 parts |
| Material containing metal ions (MS-1) | 25.0 parts |
| Polyester-modified silicone (manufactured by Shin-Etsu Kagaku: X-24-8300:) | 0.49 part |
| Post-chelate dye (M-1) | 0.005 part |
| Post-chelate dye (C-1) | 0.005 part |

-continued

| | |
|---|---|
| Methyl ethyl ketone | 80.0 parts |
| Butyl acetate | 10.0 parts |
| MS-1: $Ni^{2+}(NH_2COCH_2NH_2)_3.2B(C_6H_5)_4$— | |

(Image Formation)

An image original (a solid image of magenta, cyan and yellow with a density of 1.0) was input employing a flood bed type reflection scanner (resolving power 300 dpi); image data were transmitted to a computer through &a interface cable and image editing and color management were conducted (alternatively these data may be transmitted to another computer employing a telephone line, and via the computer, image edit and color management may be conducted).

Images were formed employing a sublimation type thermal transfer printer (the color management table which can reproduce the color displayed on a CRT is installed as ROM, and with an accuracy of superimposed printed letter of each color of 20 μm) as an output device from this computer via the interface.

The obtained image underwent post-thermal processing mentioned below. The following evaluation on image stability was performed on the image after the thermal processing was completed.

(Light Fastness)

An image with a density of about 1.0 was exposed by a Xenon Fademeter (70,000 lux) for 8 days and thereafter, the density was measured to obtain a residual density ratio.

(Humidity Resistance)

An image with a density of about 1.0 was rested at high temperature and humidity (60° C./80% relative humidity) for two weeks. Thereafter, the residual density ratio and variation ratio of image broadening (acutance value) were obtained.

Variation ratio (%)=after resting/soon after output of acutance value (Preparation of Thin sheet material Provided with Layer Comprising a Releasing Agent)

On a 100 μm PET support, the following compositions were coated with a wire bar so as to obtain a layer thickness of 1 μm and the upper layer was perfectly hardened at 100° C. for 30 minutes.

| | |
|---|---|
| Releasing Agent Layer RAL-1 | |
| Silicone resin (Toshiba Silicone: TSM6450) | 90 parts |
| Hexamethtylenediisocyanate (Nihon Polyurethane: Coronate HX) | 1 part |
| Methyl ethyl ketone | 80 parts |
| Cyclohexane | 20 parts |
| Releasing Agent Layer RAL-2 | |
| Acrylic resin (Mitsubishi Rayon: Dianal BR87) | 9 parts |
| Silicone resin particles (Toshiba Silicone: Tospearl 108) | 1 part |
| Methyl ethyl ketone | 40 parts |
| Butyl acetate | 50 parts |
| Releasing Agent Layer RAL-3 | |
| Gelatin | 9 parts |
| Propylene vinylsulfone | 1 part |
| Deionized water | 100 parts |
| Releasing Agent Layer RAL-4 | |
| Polyethylene wax emulsion (35%) (Toho Kagaku: Hitech E-1000) | 10 parts |

-continued

| | |
|---|---|
| Urethane-modified ethyleneacrylic acid polymer emulsion (25%) (Toho Kagaku: Hitech S-3125) | 15 parts |

(Re-transferability of Image Part by Thermal Process)

The density of image part was measured employing a reflection densitometer, before and after it was processed by a thermal processing device, and difference in density was obtained.

Further, a once used thin sheet material was conveyed to the heating device via an image-receiving sheet, on which an image had not been formed, and the dyeing affinity in the image-receiving material repeatedly processed was visually evaluated.

A: not perfectly dyed

B: slightly dyed in the high density areas

C: dyed at a level of being visually confirmed (Post-Heating of Image-receiving Material after Image Formation)

Example 1

A thin sheet material 4 provided with each of releasing layer RAL-1 to 4 was arranged so as to be in contact with the surface of image-forming layer 2 of the image-receiving material 3, as shown in FIG. 1 in which a 200 μm stainless steel plate 9 was placed on the reverse side of the image-receiving material and conveyed at a speed of 0.8 second/cm to a silicone rubber (rubber hardness 80) heat roller with a diameter of 5 cm heated at 190° C. so that the image-forming surface was in contact with the surface of the heat roller. The same thin sheet material was employed and processed several times.

Table 1 shows the results of the image stability and the image transferability. Frequently, however, on the heating device, the thin sheet material was subjected to formation of wrinkles and shifting from the image-receiving material.

Example 2

Figure 2:
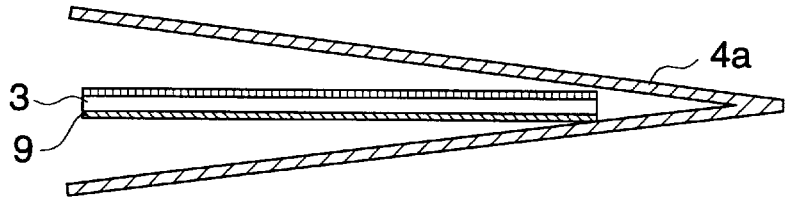
FIG. 2 is a sectional view showing a folded thin sheet material sandwiched with an image-receiving material which has completed image transfer.

A thin sheet material provided with releasing agent layers RAL-1 to 4, as shown in FIG. 2, sandwiched the image-receiving material 3 together with a 200 μm stainless steel plate 9 which was placed on the back side of the image-receiving material and was conveyed at 0.8 second/cm, while rendering the thin sheet material-folding side as a leading edge, to a rubber (rubber hardness of 80) heat roller with a diameter of 5 cm, heated at 190° C., so that the image side is in contact with the heat roller. The same thin sheet material was employed and processed several times.

The results showed that the image stability and the image transferability were the same as those in Example 1. However, neither wrinkles nor shifting from the image-forming material was caused and the operational properties were found to be superior to Example 1.

Comparative Example 1

A 200 μm PET was employed as a thin sheet material; the same thermal processing was conducted as that in Example 2, the same evaluation was performed.

Both the image stability and the image transferability were found to be inferior to Examples.

TABLE 1

| No. | Thin sheet material (composite material or support/releasing agent) | Image Stability: Light Fastness | Image Stability: Moisture Resistance | Image Transferability: Decrease in Density | Image Transferability: Dyeing Properties | Remarks |
|---|---|---|---|---|---|---|
| 1 | RAL-1 | 0.98 | 0.95 | 0 | A | Example 1 |
| 2 | RAL-2 | 0.95 | 0.95 | 0 | A | |
| 3 | RAL-3 | 0.96 | 0.95 | 0 | A | |
| 4 | RAL-4 | 0.96 | 0.92 | −0.15 | B | |
| 5 | PET | 0.93 | 0.92 | −0.52 | C | Comparative Example 1 |

Example 3

As shown in FIG. 3, a thin sheet material illustrated in Table 2, employing a 200 $\mu$m PET film 5 as another sheet material, sandwiched the image-receiving material together with a 200 $\mu$m stainless steel plate 9 which was placed on the back side of the image-receiving material and was conveyed at 0.8 second/cm, while rendering the thin sheet material-folding side as a leading edge, to a rubber (rubber hardness of 80) heat roller having a diameter of 5 cm, heated at 190° C., so that the image side is in contact with the heat roller. The same thin sheet material was employed and processed several times.

The results showed that the image stability and image transferability were the same as results in Table 2. Neither wrinkles nor shifting from the image-forming material was caused and the operational properties were found to be superior.

Further, no stainless steel plate was sandwiched together, and the thermal processing was conducted. The image stability and image transferability were the same as those Examples. However, the image-receiving layer was deformed to a wave-like form due to heat and pressure of the heat roller.

Example 4

As shown in FIG. 4, a roll of a thin sheet material 4, in which PET-MRF, product of Diafoil-Hoechst (25 $\mu$m) was employed as the releasing material, was a-ranged in front of a silicone rubber (rubber hardness of 80) heat roller 6 and the image-receiving material was passed underneath the heat roller and was wound up by a back roller 8. The releasing agent-coated surface of the thin sheet material 4 was brought into contact with the image surface, and the image-receiving material and the thin sheet material were simultaneously conveyed at a speed of 0.8 second/cm.

The results showed that the image stability and image transferability were the same as those in Table 2. Neither wrinkles nor shifting from the image-forming material was caused and the operational properties were found to be superior.

TABLE 2

| No. | Thin sheet material (composite material or support/releasing agent) | Image Stability: Light Fastness | Image Stability: Moisture Resistance | Image Transferability: Decrease in Density | Image Transferability: Dyeing Properties | Remarks |
|---|---|---|---|---|---|---|
| 6 | Synthetic Paper (Oji Yuka: YUPO, 100 g/m$^2$) | 0.97 | 0.95 | 0 | A | Example 3 |
| 7 | Paper (Nagoya Pulp): Kinshachi 50 g/m$^2$) | 0.94 | 0.93 | −0.18 | B | |
| 8 | Releasing Agent (Diafoil-Hoechst: PET-MRF 25 $\mu$m) | 0.97 | 0.97 | 0 | A | |
| 9 | Releasing Agent (Diafoil-Hoechst: PET-MRF 25 $\mu$m) | 0.97 | 0.95 | 0 | A | Example 4 |
| 10 | No Heating | 0.7 | 0.3 | — | — | Reference |

In Examples in the present invention, Table 1 and Table 2 clearly show that all are superior in the image stability, and no image transfer is caused.

The thermal processing method of the present invention can readily improve the image stability and color reproduction obtained employing a thermal transfer recording using a thermally diffusible chelatable dye without an increase in both cost and material waste.

What is claimed is:

1. A thermal transfer recording method comprising the steps of superposing a recording material comprising a first support having thereon an ink layer containing a thermally diffusible chelatable dye, and an image-receiving material comprising a second support having thereon an image-receiving layer containing a compound having metal ions, so that the ink layer of the recording material and the image-receiving layer of the image-receiving material are brought into contact with each other;

heating the superposed recording material imagewise employing a thermal head, whereby the thermally diffusible chelatable dye is transferred to the image-receiving layer to form an image;

contacting the image-receiving material having the image and a releasing agent-containing thin sheet material so that the image-receiving layer is brought into contact with the releasing agent-containing thin sheet material; and heating the image-receiving material through the thin sheet material.

2. A thermal transfer recording method of claim 1 wherein the image-receiving layer comprises a compound containing two or more valent metal ions.

3. A thermal transfer recording method of claim 1 wherein the thin sheet material comprises a releasing agent on or in the sheet material.

4. A thermal transfer recording method of claim 1 wherein the thin sheet material comprises a releasing layer on the surface.

5. A thermal transfer recording method of claim 1 wherein the thin sheet material contains a releasing agent impregnated or knead mixed in the thin sheet material.

6. A thermal transfer recording method of claim 1 wherein the thin sheet material is employed in such a state that a leading edge in the conveying direction is folded so as to sandwich the image-receiving material.

7. A thermal transfer recording method of claim 1 wherein after dye transfer the image-receiving material and the thin sheet material are sandwiched with another sheet connecting with at least one side of the material, and conveyed so that the connected side is arranged as a leading edge for conveyance.

8. A thermal transfer recording method of claim 1 wherein the thin sheet material comprises a front surface and a back surface, and is employed twice, to contact the image-receiving layer on the front and back surfaces, respectively.

9. A thermal transfer recording method of claim 1 wherein the thin sheet material comprises releasing layers on both sides.

10. A thermal transfer recording method of claim 1 wherein after dye transfer a plate-like rigid body is placed between a reverse surface of the image-forming side of the image-receiving material and the thin sheet material.

11. A thermal transfer recording method of claim 1 wherein the thin sheet material is supplied at each time when the image-receiving material completing the dye transfer is passed through the thermal processing device.

12. A thermal transfer recording method of claim 1 wherein a thermal processing device is employed which is arranged in such a way that in the second heating step, a front roller and a back roller are provided before and after, respectively, a heat roller of the thermal processing device, and the thin sheet material wound on the front roller is unwound between the heat roller and the image-receiving material, completing the dye transfer whenever the image receiving material completing the dye transfer is passed through the thermal processing device and conveyed, and the thin sheet material is wound on the back roller.

13. A thermal transfer recording method of claim 1 wherein the releasing agent is selected from fluororesins, silicone resins, fatty acid esters, paraffin or gelatin.

14. A thermal transfer recording method of claim 1 wherein glass transition temperatures of the thin sheet materials are not lower than 70° C.

15. A thermal transfer recording method of claim 1 wherein the image-receiving material is heated through the thin sheet material at 70 to 200° C. with conveying speed of 0.3 to 3.0 m/sec.

* * * * *